US006442364B2

(12) United States Patent
Kai et al.

(10) Patent No.: US 6,442,364 B2
(45) Date of Patent: Aug. 27, 2002

(54) IMAGE FORMING APPARATUS HAVING A DEVELOPER CARRIER CAPABLE OF PREVENTING TONER ADHESION

(75) Inventors: Tsukuru Kai; Nobutaka Takeuchi, both of Kanagawa; Takeyoshi Sekine, Tokyo; Nobuo Takami; Osamu Ariizumi, both of Kanagaw, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/794,077

(22) Filed: Feb. 28, 2001

(30) Foreign Application Priority Data

Feb. 28, 2000 (JP) ..... 2000-051645

(51) Int. Cl.[7] ..... G03G 15/09
(52) U.S. Cl. ..... 399/277
(58) Field of Search ..... 399/55, 252, 260, 399/265, 267, 270, 276, 277, 279; 492/8

(56) References Cited

U.S. PATENT DOCUMENTS 4,511,239 A * 4/1985 Kanbe et al. ..... 399/275 X
5,771,429 A * 6/1998 Oyama et al. ..... 399/260
5,937,228 A * 8/1999 Shoji et al. ..... 399/55

* cited by examiner

*Primary Examiner*—Sophia S. Chen
*Assistant Examiner*—Hoan Tran
(74) *Attorney, Agent, or Firm*—Oblon, Spivak, McClelland, Maier & Neustadt, P.C.

(57) ABSTRACT

An image forming apparatus of the present invention includes a developing roller accommodating a magnet roller therein. The magnet roller includes a main pole forming a magnetic flux whose attenuation ratio is 40% or above in the direction normal to the developing roller. The axis A of the developer carrier, the axis B of the image carrier and the peak C of the magnetic force of the main pole in the above direction are positioned such that an angle between a line AB and a line AC is substantially zero degree.

16 Claims, 5 Drawing Sheets

IMAGE FORMING APPARATUS HAVING A DEVELOPER CARRIER CAPABLE OF PREVENTING TONER ADHESION

BACKGROUND OF THE INVENTION

The present invention relates to an image forming apparatus of the type scooping up a developer to a developer carrier, causing the developer to form a magnet brush on the developer carrier, and causing the magnet brush to contact an image carrier to thereby develop a latent image formed on the image carrier. More particularly, the present invention relates to an image forming apparatus capable of preventing the developer from adhering to the developer carrier.

It is a common practice with a copier, printer, facsimile apparatus or similar electrophotographic or electrostatic recording type of image forming apparatus to use an image carrier implemented by, e.g., a photoconductive drum or a photoconductive belt. A latent image is electrostatically formed on the image carrier in accordance with image data. The latent image is developed by a developer to become a toner image.

Today, a magnet brush type developing system, which uses a toner and carrier mixture as a developer, is predominant over the other developing systems in the aspect of image transfer, halftone reproducibility, and stability against varying temperature and humidity. In this type of developing system, the toner and carrier mixture, i.e., two-ingredient type developer rises from a developer carrier in the form of brush chains. In a developing region, the toner contained in the developer is fed to a latent image formed on an image carrier to thereby form a corresponding toner image. The developing region refers to a range over which the magnet brush rises from the developer carrier and contacts the image carrier.

Usually, the developer carrier is implemented by a cylindrical sleeve. A magnet roller is disposed in the sleeve in order to cause the developer deposited on the sleeve to rise. More specifically, the carrier of the developer rises from the sleeve in the form of chains along the magnetic lines of force formed by the magnet roller. The carrier, which has been charged, deposits on the carrier rising from the sleeve. The magnet roller has a plurality of magnetic poles each being implemented by, e.g., a rod-like magnet. Particularly, a main magnetic pole for development is positioned in the developing region in order to cause the developer to rise. Either one of the sleeve and magnet roller is movable relative to the other so as to move the developer rising from the sleeve. In the developing region, the developer rises in the form of chains along the magnetic lines of force formed by the main pole and contacts the surface of the image carrier. The chains rub themselves against the latent image on the basis of a difference in linear velocity between the chains and the image carrier, thereby feeding the toner to the latent image.

The distance between the developer carrier and the image carrier at a point where they are closest to each other, i.e., a gap for development has critical influence on image quality. If the gap is excessively great, then the amount of toner to deposit on the edges of the latent image increases, resulting in an undesirable edge-enhanced image. While this may be coped with by reducing the gap, an excessively small gap extends an electric field for development and thereby increases development gamma. Development gamma should be confined in an adequate range because it would deteriorate tonality if excessively high of would obstruct the deposition of the maximum amount of toner is excessively low.

Development gamma is proportional to the linear velocity ratio of the sleeve, i.e., the ratio of the peripheral speed of the sleeve to that of the image carrier. To lower excessively high development gamma to a desired value, there may be reduced the rotation speed of the sleeve and therefore the linear velocity ratio of the sleeve. Although this kind of scheme recovers tonality, it lowers the developing ability. Consequently, at a nip where the magnet brush on the sleeve rubs itself against the image carrier, the pressure of the developer acting on the image carrier increases and causes the toner to adhere.

The adhered toner causes the torque for rotating the developer carrier to increase, so that irregular drive and therefore banding occurs at the gear pitch of a driveline including a drive gear. At the same time, the adhered toner makes the drive of the image carrier irregular. In the case of a latent image formed by, e.g., a laser in the form of dots, the irregular drive of the image carrier results in irregular distance between the dots and therefore banding. Moreover, if image formation is continued in the above conditions, the toner is apt to shave off the photoconductive layer of the image carrier or to stop the drive of the image carrier due to the difference in linear velocity between the image carrier and the sleeve.

Another conventional scheme for the reduction of the edge-enhanced image is to use an AC bias as a bias for development. The AC bias lowers the electric resistance of the chains of the magnet brush and thereby substantially reduce the gap for development. The AC bias, however, increases development gamma. Again, to reduce development gamma, the linear velocity ratio of the sleeve must be lowered.

To obviate the adhesion of toner, it has been customary to incline the main pole angle of the magnet roller to the upstream side in the direction of rotation of the developer carrier. The main pole angle refers to an angle between a line connecting the axis of the developer carrier and the peak of the magnetic force of the main pole, which is normal to the developer carrier, and a line connecting the axis of the developer carrier and that of the image carrier. If the main pole angle is around zero degree, then the developer conveying speed at the nip is lowered and causes the pressure of the developer acting on the image carrier to increase. This makes it difficult to increase the linear velocity ratio of the sleeve and is apt to bring about adhesion. In this manner, none of the conventional schemes can obviate the adhesion of toner although improving tonality by reducing the rotation speed of the developer carrier.

How the toner adheres will be described hereinafter. Adhesion is apt to occur when the regular gap width for development decreases due to the oscillation of the image carrier and that of the developer carrier or when the developer is scooped up to the developer carrier in more than a regular amount. Assume that the amount of developer being scooped up to the developer carrier locally increases. Then, when such an amount of developer is conveyed through the nip while being pressed, a stress ascribable to the narrow gap causes the toner to dynamically soften or to thermally soften and melt or causes wax contained in the toner to dynamically ooze out. As the other toner or carrier begins to gather and core together with the softened and melted toner, such a portion forms a core with the result that the adhered portion grows little by little. The adhesion sometimes begins at substantially a single position and sequentially grows in the circumferential direction and sometimes grows at a plurality of positions.

The adhesion of the toner occurs even when its fluidity is lowered, e.g., when the lower content of the developer in the developing device increases or when the amount of stray toner whose amount of charge has been reduced due to the aging of the developer increases. Further, the adhesion of the toner occurs when the surface roughness and therefore conveying ability of the sleeve is reduced due to aging, when the sleeve temperature rises due to a hot environment or continuous copying, or when the sleeve is noticeably contaminated.

SUMMARY OF THE INVENTION

It is therefore an object of the present invention to provide an image forming apparatus capable of freeing the toner of a developer from adhesion.

In accordance with the present invention, in an image forming apparatus for scooping up a developer to a developer carrier, causing the developer to form a magnet brush on the developer carrier, and causing the magnet brush to contact an image carrier to thereby develop a latent image formed on the image carrier, the developer carrier includes a nonmagnetic sleeve and a stationary magnet roller disposed in the sleeve. The magnet roller has magnetic poles for conveying the developer and a main pole for causing the developer to rise from the sleeve. The main pole has a flux density of about 40% in the direction normal to the sleeve. The axis A of the developer carrier, the axis B of the image carrier and the peak C of the magnetic force of the main pole in the above direction are positioned such that an angle between a line AB and a line AC is substantially zero degree.

Also, in accordance with the present invention, in an image forming apparatus of the type described, the developer carrier includes a nonmagnetic sleeve and a stationary magnet roller disposed in the sleeve. The magnet roller has magnetic poles for conveying the developer and a main pole for causing the developer to rise from the sleeve. The main pole has a half-width of 22° or less. The axis A of the developer carrier, the axis B of the image carrier and the peak C of the magnetic force of the main pole in the above direction are positioned such the an angle between a line AB and a line AC is substantially zero degree.

Further, in accordance with the present invention, in an image forming apparatus of the type described, the developer carrier includes a nonmagnetic sleeve and a stationary magnet roller disposed in the sleeve. The magnet roller has magnetic poles for conveying the developer and a main pole for causing the developer to rise from the sleeve. The magnet roller further includes an auxiliary magnet for helping the main pole form a magnetic force. The axis A of the developer carrier, the axis B of the image carrier and the peak C of the magnetic force of the main pole in the above direction are positioned such that an angle between a line AB and a line AC is substantially zero degree.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
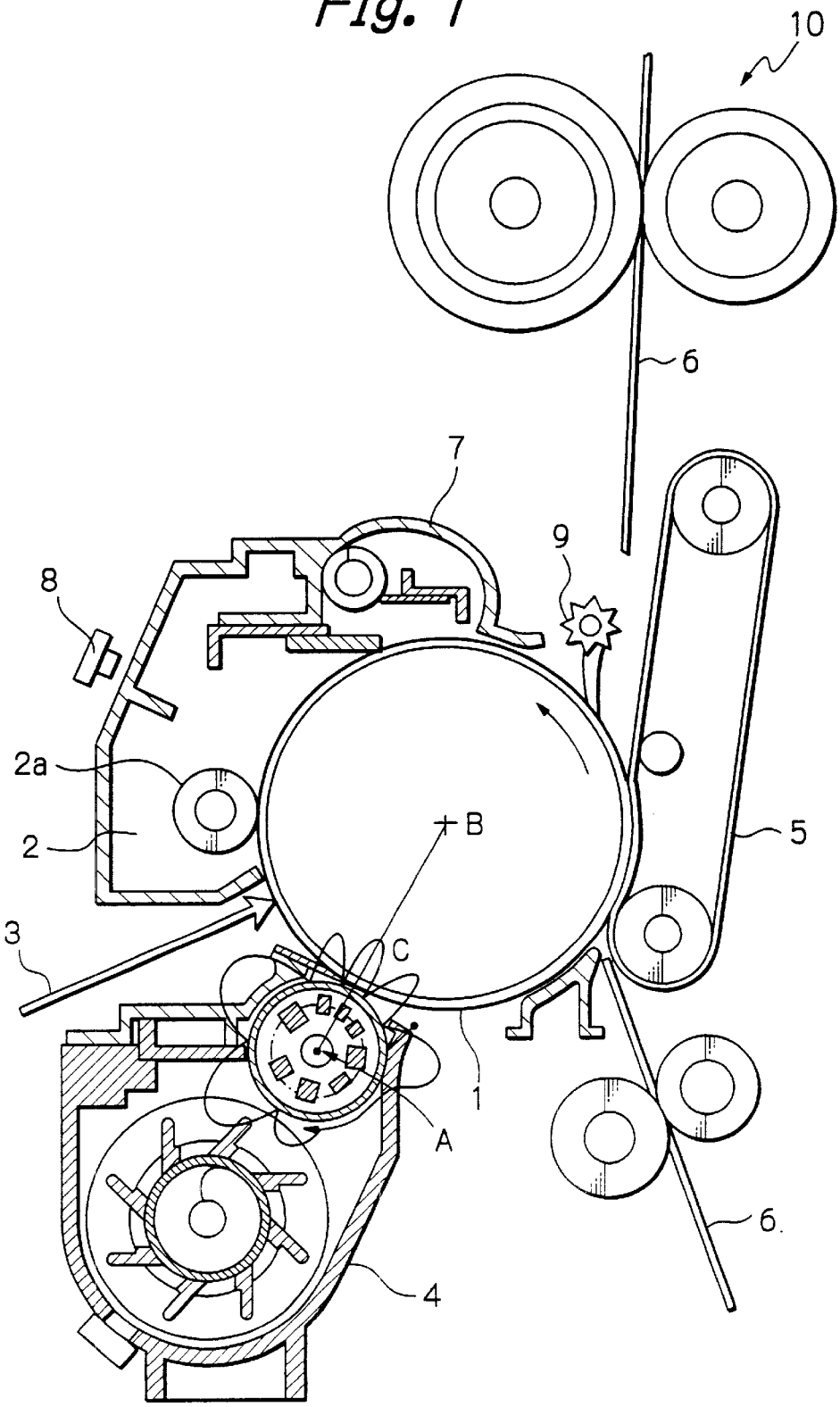
FIG. 1 is a view showing an image forming apparatus embodying the present invention.

Referring to FIG. 1 of the drawings, an image forming apparatus embodying the present invention is shown. As shown, the image forming apparatus includes a photoconductive element implemented as a drum 1. The drum 1 is a specific form of an image carrier. Sequentially arranged around the drum 1 are a charger 2, exposing optics represented by a laser beam 3, a developing device 4, an image transferring device 5, a cleaning device 7, and a discharge lamp 8. These constituents 1 through 8 are constructed into a unit.

The charger 2 uniformly charges the surface of the drum 1. The laser beam 3 scans the charged surface of the drum 1 for thereby forming a latent image. The developing device 4 develops the latent image to thereby produce a corresponding toner image. The image transferring device 5 transfers the toner image to a paper sheet or similar recording medium 6. The cleaning device 7 removes toner left on the drum 1 after the image transfer. Subsequently, the discharge lamp 8 discharges potential left on the drum 1 in order to prepare the drum 1 for the next image forming cycle.

Note specifically, in the illustrative embodiment, the image transferring device 5 is implemented by an endless belt. The toner image is transferred to a paper sheet 6 fed from a paper tray not shown. A peeler 9 peels off the paper sheet electrostatically adhered to the drum 1 during image transfer. A developing device 10 fixes the toner image transferred to the paper sheet 6.

Figure 2:
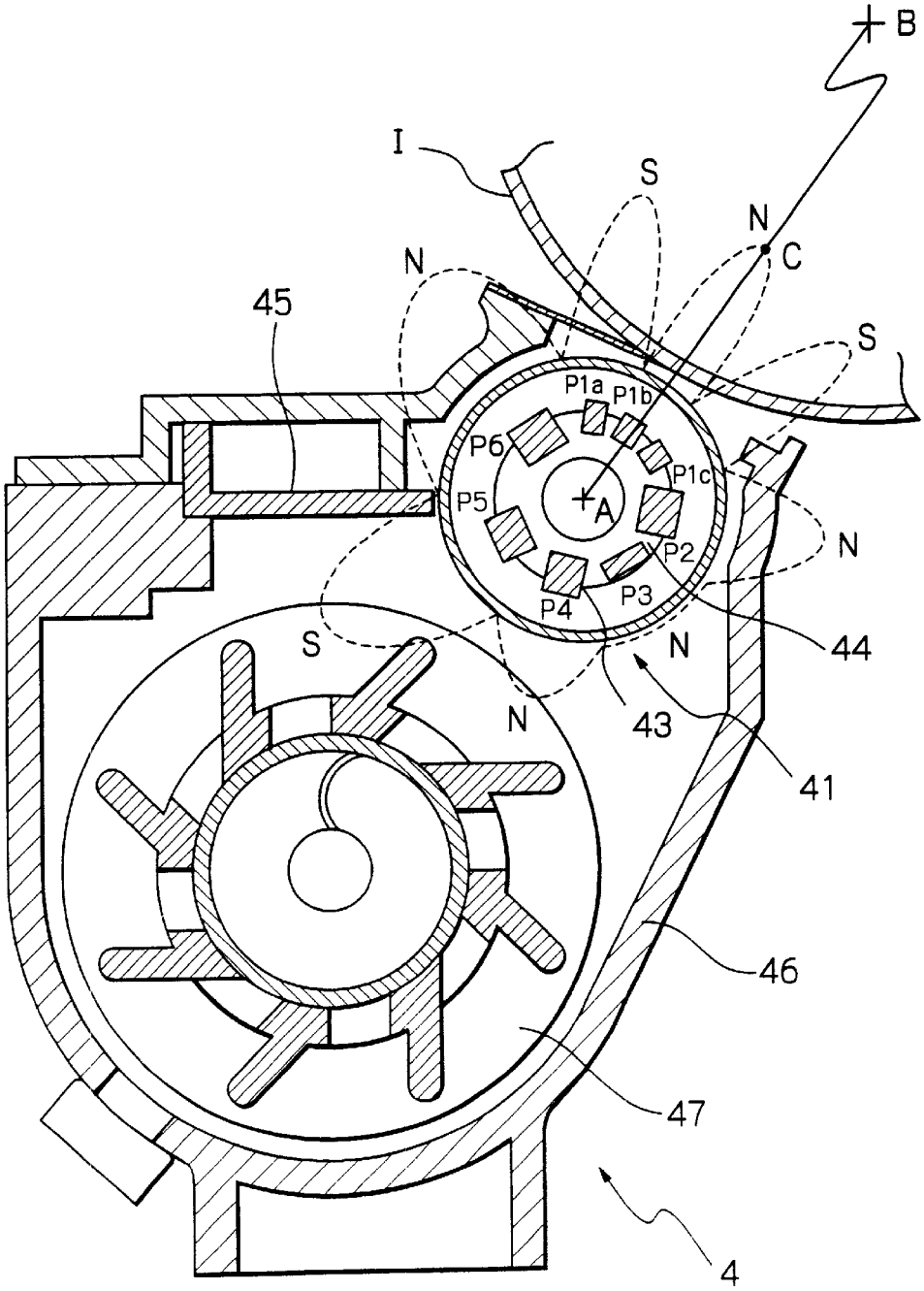
FIG. 2 is a fragmentary view showing a developing device included in the illustrating embodiment.

FIG. 2 shows a specific configuration of the developing device 4. As shown, the developing device 4 includes a developing roller or developer carrier 41 adjoining the drum 1. The drum 1 and developing roller 41 form a developing region therebetween where the drum 1 and a magnet brush formed on the roller 41 contact each other. The developing roller 41 includes a cylindrical sleeve 43 formed of aluminum, brass, stainless steel, conductive resin or similar nonmagnetic material. A drive mechanism, not shown, causes the sleeve 43 to rotate clockwise, as viewed in FIG. 2. In the illustrative embodiment, the drum 1 has a diameter of 60 mm and moves at a linear velocity of 240 mm/sec. The sleeve 43 has a diameter of 20 mm and moves at a linear velocity of 600 mm/sec, which is 2.5 times as high as the linear velocity of the drum 1.

A gap for development between the drum 1 and the sleeve 43 is selected to be 0.4 mm. Assuming that carrier particles have a diameter of 50 $\mu$m, then it has been customary to provide the above gap with a size of 0.65 mm to 0.8 mm, which is more than 10 times as great as the particle size. By contrast, in the illustrative embodiment, the gap should preferably be less than 10 times the particle size (0.55 mm). A gap greater than such a size would prevent an image form achieving desirable density.

A doctor blade 45 is positioned upstream of the developing region in the direction in which the sleeve 43 conveys a developer, i.e., the clockwise direction as viewed in FIG. 2. The doctor blade 45 regulates the amount of the developer to deposit on the sleeve 43, i.e., the height of the developer rising in the form of chains. A doctor gap between the sleeve 43 and the doctor blade 45 is selected to be 0.4 mm. A screw 47 faces the portion of the developing roller 41 opposite to the portion that faces the drum 1. The screw 47 scoops up the developer stored in a casing 46 to the developing roller 41 while agitating it.

A stationary magnet roller 44 is disposed in the sleeve 43 in order to form magnetic fields that cause the developer to rise on the circumference of the sleeve 43. Specifically, carrier particles contained in the developer rise on the sleeve 43 in the form of chains along magnetic lines of force, which are normal to the sleeve 43. Charged toner particles also contained in the developer deposit on such carrier particles, forming a magnet brush. The sleeve 43 conveys the magnet brush formed thereon in the direction in which the sleeve 43 rotates, i.e., in the clockwise direction as viewed in FIG. 2.

The magnet roller 44 includes a plurality of magnetic poles, i.e., magnets P1*a*, P1*b*, P1*c*, P2, P3, P4, P5 and P6 that are oriented in the radial direction of the sleeve 43. The magnet P1*b* is a main magnet for causing the developer to rise in the developing region. The magnets P1*a* and P1*c* are auxiliary magnets for helping the main magnet P1*b* exert a magnetic force. The magnet P4 scoops up the developer to the sleeve 43. The magnets P5 and P6 convey the developer deposited on the sleeve 43 to the developing region. The magnets P2 and P3 convey the developer in the region following the developing region.

While the magnet roller 44 is shown as having eight magnetic poles, it may be provided with, e.g. ten or twelve magnetic poles with additional poles being arranged between the pole P3 and the doctor blade 45.

As shown in FIG. 2, the poles P1*a*, P1*b* and P1*c*, constituting a main pole group P1, are sequentially arranged from the upstream side to the downstream side, and each are implemented by a magnet having a small cross-sectional area. While such magnets are formed of a rare-earth alloy, they may be formed of a samarium alloy, particularly samarium-cobalt alloy. A magnet formed of a neodymium-iron-boron alloy, which is a typical rare-earth alloy, has the maximum energy product of 358 kJ/m$^3$. On the other hand, a magnet formed of a neodymium-boron alloy bond has the maximum energy product of about 80 kJ/m$^3$. This kind of material allows the magnets to exert required magnetic forces even when noticeably miniaturized.

The maximum energy products available with a conventional ferrite magnet and a ferrite bond magnet are about 36 kJ/m$^3$ and 20 kJ/m$^3$, respectively. If the diameter of the sleeve 43 is not so strictly limited, then it is possible to use relatively large-sized ferrite or ferrite bond magnets or to taper off the ends of the magnets facing the sleeve 43 for thereby reducing the half-width.

In the illustrative embodiment, the magnets each have a small cross-sectional area, as stated earlier. Alternatively, the magnets may be molded integrally with each other. Also, the magnets other than the magnet group P1 may be implemented by a single molding, and the magnet group P1 may be formed individually and then combined together or may be molded integrally with each other. Further, a sectorial magnet may be adhered to the shaft of a magnet roller.

Figure 3:
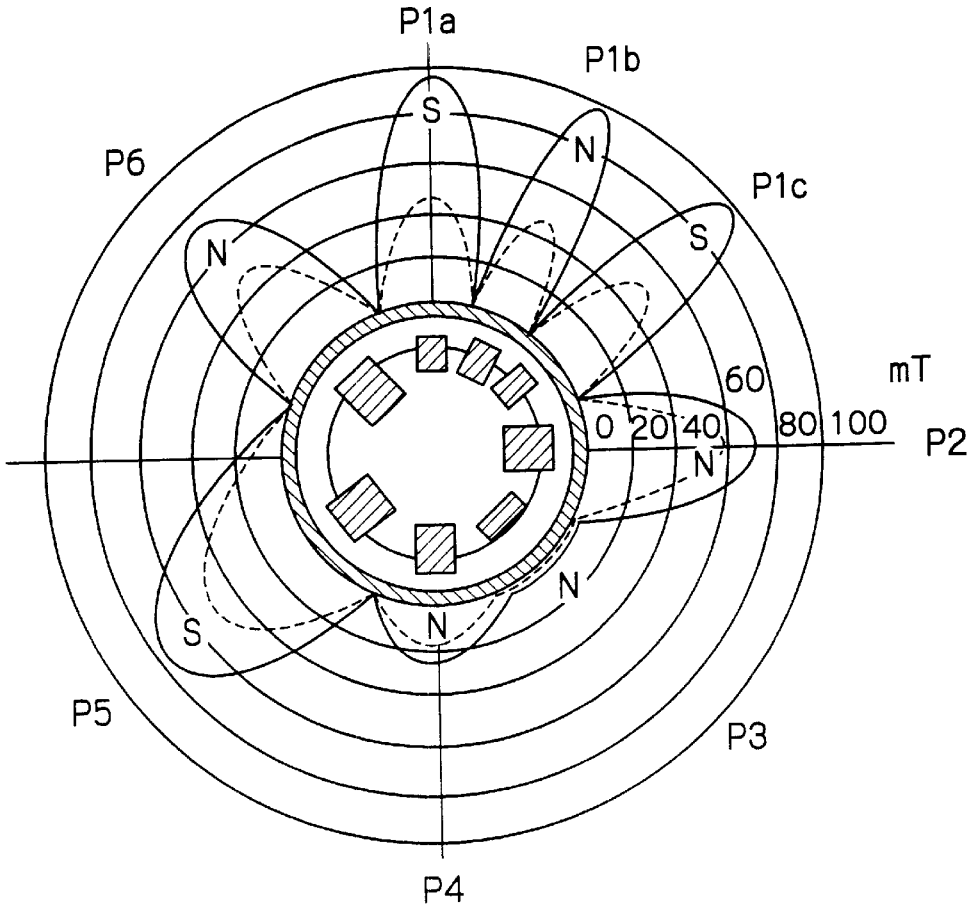
FIG. 3 is a chart showing the distribution and sizes of magnetic forces exerted by a developing roller, which is included in the developing device of FIG. 2.

In the illustrative embodiment, the main magnet P1*b*, magnet P4 for scooping up the developer, magnet P6 for conveying the developer to the developing region and magnets P2 and P3 in charge of the region following the developing region are implemented as N poles. The auxiliary magnets P1*a* and P1*c* and magnet P5 are implemented as S poles. FIG. 3 is a chart showing flux densities measured in the direction normal to the sleeve 43. As shown, the main magnet P1*b* exerts a magnetic force of 85 mT or above in the normal direction to the developing roller 41. A tangential magnetic force relates to the deposition of the carrier. While the magnetic forces of the magnets P1*b*, P1*a* and P1*c* must be increased to increase the tangential magnetic force, the deposition of the carrier can be reduced if the magnetic force of any one of the magnets P1*b* through P1*c* is sufficiently intensified. The magnets P1*b* through P1*c* each had a width of 2 mm while the half-width of the magnet P1*b* was 16°.

Figure 4:
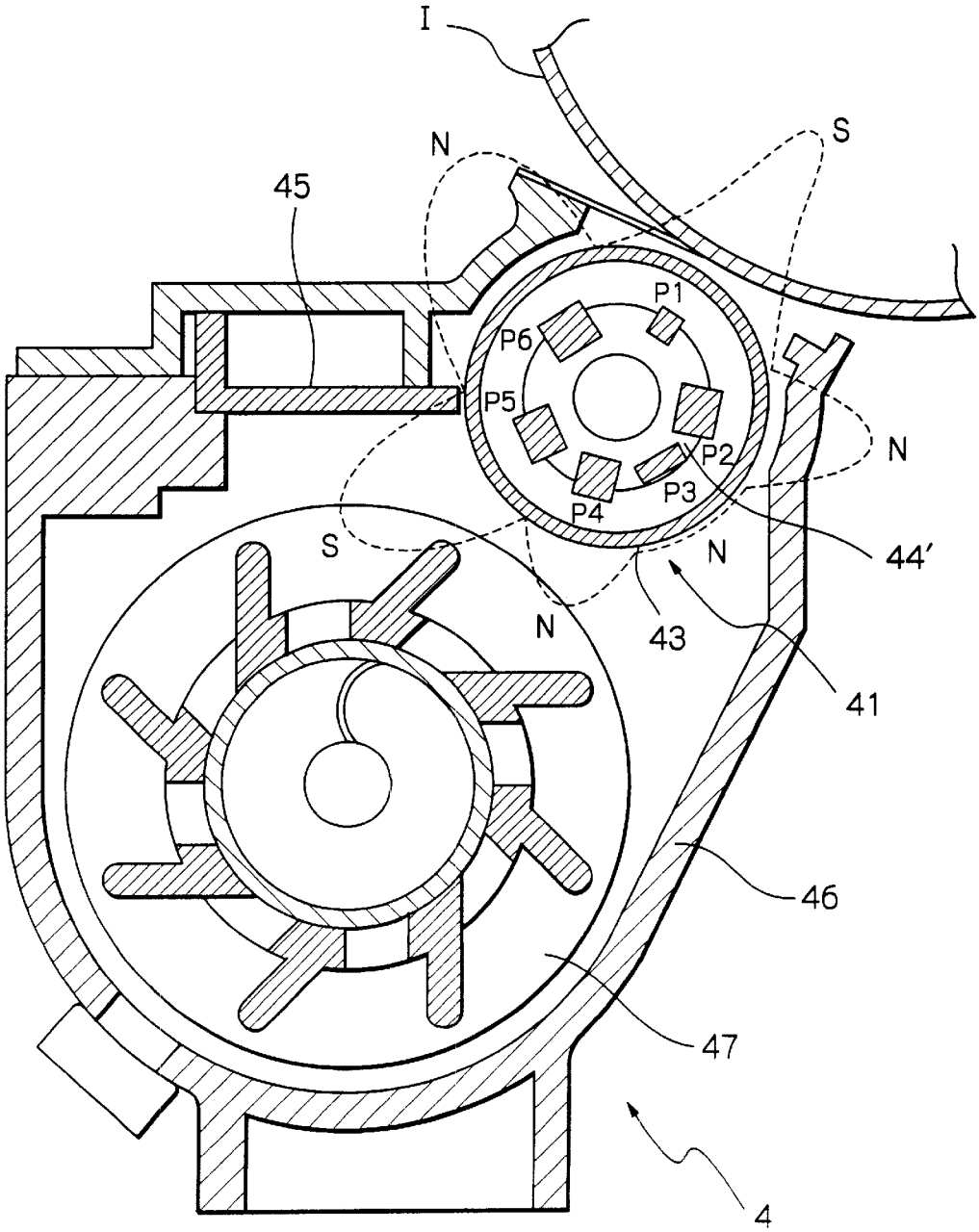
FIG. 4 is a view showing an alternative embodiment of the present invention.

Reference will be made to FIG. 4 for describing an alternative embodiment of the present invention. This embodiment is identical with the previous embodiment except for the configuration of the magnet roller. In FIG. 4, structural elements identical with the structural elements shown in FIG. 2 are designated by identical reference numerals, and a detailed description thereof will not be made in order to avoid redundancy.

As shown in FIG. 4, a magnet roller 44' has magnets P1, P4, P5, P6, P2 and P3 each being oriented in the radial direction of the sleeve 43. The magnet P1 is a main magnet for causing the developer to rise in the form of chains in the developing region. The magnet P4 scoops up the developer to the sleeve 43. The magnets P5 and P6 convey the developer deposited on the sleeve 43 to the developing region. The magnets P2 and P3 convey the developer in the region following the developing region. The magnet roller 44' does not have any auxiliary pole around the main pole.

In the illustrative embodiment, the magnet roller 44' has six magnets. Again, additional magnets or poles may be arranged between the pole P3 and the doctor blade 45 such that the magnet roller 44' has eight or more poles in total. This is successful to promote the efficient scoop-up of the developer and to enhance the ability to follow a black solid image.

Figure 5:
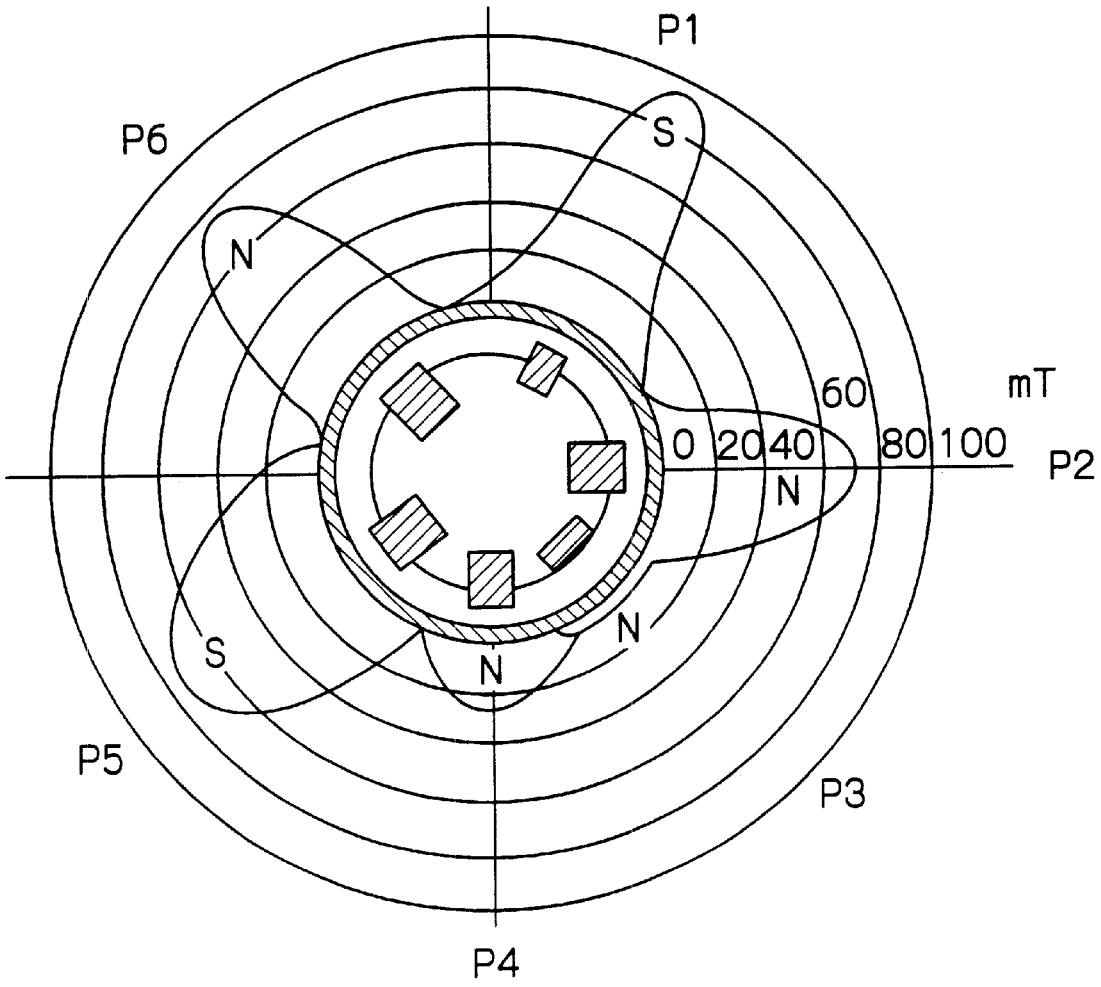
FIG. 5 is a chart showing the distribution and sizes of magnetic forces exerted by a developing roller, which is included in the alternative embodiment.

The main magnet P1 has a small cross-sectional area, as in the previous embodiment. While such a magnet is formed of a rare-earth alloy, it may be formed of a samarium alloy, particularly samarium-cobalt alloy. If the diameter of the sleeve 43 is not so strictly limited, then it is possible to use a ferrite or ferrite bond magnet whose end facing the sleeve 43 is tapered off thereby reducing the half-width. In the illustrative embodiment, the magnets P4, P6, P2 and P3 are implemented as N poles while the main magnet P1 and magnet P5 are implemented as S poles. FIG. 5 is a chart similar to FIG. 5, showing the distribution of magnetic forces.

Reference will again be made to FIG. 3 for studying the attenuation ratio of a flux density in the direction normal to the developing roller 41. In FIG. 3, solid lines are indicative of flux densities measured on the surface of the sleeve 43 while dotted lines are indicative of flux densities measured at positions spaced from the sleeve surface by 1 mm. The flux densities were measured by a gauss meter HGB-8300 and an A1 type axial probe available from ADS and recorded by a circular chart recorder.

As shown in FIG. 3, the flux density of the main magnet P1*b* in the direction normal to the sleeve 43 is 95 mT on the surface of the sleeve 43 and 44.2 mT at the position spaced from the sleeve surface by 1 mm. The attenuation ratio is therefore 53.5% in the normal direction. When the maximum magnetic force of the main magnet is 95 mT in the normal direction, the half-value is 47.5 mT while the half-width is 22°. It was experimentally found that half-widths greater than 22° rendered images defective.

The flux density of the auxiliary magnet P1*a* upstream of the main magnet P1*b* in the direction normal to the sleeve 43 is 83 mT on the surface of the sleeve 43 and 49.6 mT at the position spaced from the sleeve surface by 1 mm. The attenuation ratio is therefore 46.7% in the normal direction.

Likewise, the flux density of the auxiliary magnet P1*c* downstream of the main magnet P1*b* in the direction normal to the sleeve 43 is 92 mT on the surface of the sleeve 43 and 51.7 mT at the position spaced from the sleeve surface by 1 mm. The attenuation ratio is therefore 43.8% in the normal direction.

In the illustrative embodiment, only part of the magnet brush, which is formed on the sleeve 43, corresponding to the main pole P1*b* contacts the drum 1 and develops a latent image formed on the drum 1. The height of the magnet brush was measured without the drum 1 contacting the magnet brush. The measurement showed that at the position corresponding to the main pole P1*b*, the magnet brush was about 1.5 mm high, which was lower than about 3 mm particular to a conventional magnet brush, and dense. More specifically, for a given distance between the doctor blade 45 and the sleeve 43, i.e., for a given amount of developer to pass the doctor blade 45, the magnet brush available with the illustrative embodiment was shorter and more dense than the conventional magnet brush.

The above-described phenomenon will be seen from the pattern shown in FIG. 3 also. As shown, the flux density in the normal direction noticeably decreases at the position spaced from the sleeve surface by 1 mm. Therefore, the developer cannot form a magnet brush at a position remote from the sleeve 43, but forms a short, dense magnet brush on the surface of the sleeve 43. In this connection, a conventional magnet brush formed by a main pole on the surface of a developing sleeve is 73 mT in the direction normal to the sleeve and 51.8 mT at a position spaced from the sleeve surface by 1 mm in the same direction. The attenuation ratio is therefore only 29%.

By reducing the half-width, it is possible to increase the attenuation ratio, as determined by experiments. The half-width can be reduced if the width of a magnet in the circumferential direction of a sleeve is reduced. For example, in the arrangement shown in FIG. 2, the magnets P1*b*, P1*a* and P1*c* are 2 mm wide each, and the half-width of the magnet P1*b* is 16°. By contrast, a main magnet, which was 1.6 mm wide, was found to have a half-width of 12°. A decrease in half-width translates into an increase in the amount of magnetic lines of force that turn round to adjoining magnets, thereby reducing the flux density at a position remote from the sleeve surface in the normal direction. A magnet roller and a sleeve are spaced from each other by a substantial gap derived from a space necessary for the sleeve to rotate and the thickness of the sleeve. The substantial gap causes the position of the tangential flux density to substantially concentrate on the sleeve side. This is why the flux density in the normal direction decreases with an increase in the distance to the sleeve surface.

A magnet roller with a great attenuation ratio forms a short, dense magnet brush while a conventional magnet roller with a small attenuation ratio forms a long, rough magnet brush. More specifically, a magnetic field formed by a magnet with a great attenuation ratio (e.g. P1*b*) is easily attracted by adjoining magnets (e.g. P1*a* and P1*c*). As a result, the magnetic field turns round in the tangential direction more than it extends in the normal direction, so that the flux density in the normal direction decreases. This makes it difficult for a magnet brush to be formed in the normal direction and thereby makes a magnet brush short and dense. For example, the magnet brush formed by the magnet P1*b*, which has a great attenuation ratio, is more stable when short and dense than when long and rough. As for a conventional magnet roller with a small attenuation ratio, a magnet brush does not decrease in height, but is as long as the previously stated magnet brush, even if the amount of developer to be scooped up is reduced.

A great attenuation ratio is also achievable if the auxiliary magnets adjoining the main magnet in the circumferential direction of the sleeve are brought closer to the main magnet. This increases the amount of magnetic lines of force to flow into the auxiliary magnets and therefore the attenuation ratio.

As shown in FIG. 1, assume that the drum 1 has an axis B. As shown in FIG. 2, assume that the developing roller 41 has an axis A, and that the magnetic force of the main pole P1*b* has a peak C in the normal direction. Then, in accordance with the present invention, the magnet brush formed by the main pole P1*b* is small size, i.e., rises and falls over a minimum of width and is therefor low in height. Even if the angle between a line AB and a line AC is substantially zero degree, the stress to act on the developer between the developing roller 41 and the drum 1 is small. This, coupled with the fact that the developer of the magnet brush stays little, causes a minimum of developer to adhere to the sleeve 41.

Moreover, the linear velocity of the sleeve 41 can be lowered to realize desired development gamma, so that an image with desirable tonality is achievable. In addition, there can be reduced the omission of the trailing edge portion of an image that is ascribable to the position of a main pole inclined toward the upstream side in the direction of rotation of a sleeve.

An AC bias further enhances the improved tonality derived from the lower linear velocity of the sleeve 41. Specifically, attractive images were produced when the linear velocity ratio was 1.2, the peak-to-peak voltage Vpp was 0.8 kV, the frequency f was 4.5 kHz, the gap for development was 0.4 mm, and the amount of developer scooped was 0.065 mg/cm$^2$.

Various modifications will become possible for those skilled in the art after receiving the teachings of the present disclosure without departing from the scope thereof.

What is claimed is:

1. An image forming apparatus comprising:

an image carrier configured to form a latent image thereon; and a developer carrier configured to form a magnet brush with a developer thereon such that said magnet brush makes contact with said image carrier to thereby develop the latent image, said developer carrier including a nonmagnetic sleeve and a stationary magnet roller disposed in said nonmagnetic sleeve, said stationary magnet roller being configured to form a plurality of magnetic poles for conveying the developer and a main pole for causing the developer to rise from said nonmagnetic sleeve;

wherein:

said main pole has a flux density whose attenuation ratio is equal to or above 40% in a direction normal to said nonmagnetic sleeve; and an axis A of the developer carrier, an axis B of the image carrier and a peak C of a magnetic force of said main pole in said direction are positioned such that an angle between a line AB and a line AC is substantially zero degree.

2. The apparatus as claimed in claim 1, wherein the latent image is developed by an alternating electric field.

3. The apparatus as claimed in claim 1, wherein said magnetic roller comprises a plurality of magnets positioned to form said plurality of magnetic poles and at least one main magnet position to form said main magnetic pole.

4. The apparatus as claimed in claim 3, wherein said at least one main magnet comprises a main magnet and at least one auxiliary magnet.

5. The apparatus as claimed in claim 1, wherein said attenuation ratio is above 40%.

6. An image forming apparatus comprising:

an image carrier configured to form a latent image thereon; and a developer carrier configured to form a magnet brush with a developer thereon such that said magnet brush makes contact with said image carrier to thereby develop the latent image, said developer carrier including a nonmagnetic sleeve and a stationary magnet roller disposed in said nonmagnetic sleeve, said stationary magnet roller being configured to form a plurality of magnetic poles for conveying the developer and a main pole for causing the developer to rise from said nonmagnetic sleeve in a direction normal to said nonmagnetic sleeve;

wherein:

said main pole has a flux density whose attenuation ratio is equal to or above 40% in said direction;

said main pole has a half-width of 22° or less; and an axis A of the developer carrier, an axis B of the image carrier and a peak C of a magnetic force of said main pole in said direction are positioned such that an angle between a line AB and a line AC is substantially zero degree.

7. The apparatus as claimed in claim 6, wherein the latent image is developed by an alternating electric field.

8. The apparatus as claimed in claim 6, wherein said magnetic roller comprises a plurality of magnets positioned to form said plurality of magnetic poles and at least one main magnet position to form said main magnetic pole.

9. The apparatus as claimed in claim 8, wherein said at least one main magnet comprises a main magnet and at least one auxiliary magnet.

10. The apparatus as claimed in claim 6, wherein said attenuation ratio is above 40%.

11. An image forming apparatus comprising:

an image carrier configured to form a latent image thereon; and a developer carrier configured to form a magnet brush with a developer thereon such that said magnet brush makes contact with said image carrier to thereby develop the latent image, said developer carrier including a nonmagnetic sleeve and a stationary magnet roller disposed in said sleeve, said magnet roller being configured to form a plurality of magnetic poles for conveying the developer and a main pole for causing the developer to rise from said nonmagnetic sleeve in a direction normal to said nonmagnetic sleeve, said stationary magnet roller including at least one auxiliary magnet for helping said main pole form a magnetic force;

wherein:

said at least one auxiliary magnet is positioned such that said main pole has a flux density whose attenuation ratio is equal to or above 40% in a direction normal to said nonmagnetic sleeve; and an axis A of the developer carrier, an axis B of the image carrier and a peak C of a magnetic force of said main pole in said direction are positioned such that an angle between a line AB and a line AC is substantially zero degree.

12. The apparatus as claimed in claim 11, wherein the latent image is developed by an alternating electric field.

13. The apparatus as claimed in claim 11, wherein said at least one auxiliary magnet is positioned at least one of an upstream side and a downstream side of a main magnet, which forms said main pole, in a direction in which the developer is conveyed.

14. The apparatus as claimed in claim 13, wherein the latent image is developed by an alternating electric field.

15. The apparatus as claimed in claim 11, wherein said magnetic roller comprises a plurality of magnets positioned to form said plurality of magnetic poles and at least one main magnet position to form said main magnetic pole.

16. The apparatus as claimed in claim 11, wherein said attenuation ratio is above 40%.

* * * * *